United States Patent [19]

Hale et al.

[11] 4,422,801

[45] Dec. 27, 1983

[54] BUOYANCY SYSTEM FOR LARGE SCALE UNDERWATER RISERS

[75] Inventors: Neville E. Hale, Mississauga, Canada; Kenneth Gardner, Santa Barbara, Calif.

[73] Assignee: Fathom Oceanology Limited, Mississauga, Canada

[21] Appl. No.: 186,506

[22] Filed: Sep. 11, 1980 (Under 37 CFR 1.47)

[30] Foreign Application Priority Data

Sep. 28, 1979 [CA] Canada ..... 336655

[51] Int. Cl.[3] ..... E21B 7/12

[52] U.S. Cl. ..... 405/195; 166/350; 441/133

[58] Field of Search ..... 405/171, 195, 206, 209; 166/350; 175/7; 441/1, 133

[56] References Cited

U.S. PATENT DOCUMENTS

| | | | |
|---|---|---|---|
| 3,017,934 | 1/1962 | Rhodes et al. | 166/350 |
| 3,359,741 | 12/1967 | Nelson | 166/350 X |
| 3,729,756 | 5/1973 | Cook et al. | 166/350 X |
| 3,858,401 | 1/1975 | Watkins | 166/350 X |
| 4,102,142 | 7/1978 | Lee | 405/195 |
| 4,176,986 | 12/1979 | Taft et al. | 405/195 X |

*Primary Examiner*—David H. Corbin
*Attorney, Agent, or Firm*—Donald E. Hewson

[57] ABSTRACT

A buoyancy system for large scale underwater risers is provided, comprising a plurality of canisters. Each of the canisters extends partially around the circumference of a riser—usually, two canisters and the support structure surround a riser—and a plurality of canisters is associated with each riser section. Air is injected into the lowermost canister or canisters, at a pressure sufficient to displace the contained water within the canister; and when the water level within a canister is lowered sufficiently that a port in a cross connected tube is uncovered, the compressed air enters the tube and travels upwardly to the next canister above, where the unwatering sequence is repeated. Because very great depth can be accommodated—3,000 meters or more—provision is made for reflooding the canisters in the event of an emergency. Additionally, because of pneumatic considerations, different configurations of cross tube are provided for installation in the canisters at varying depths. The support structure for the canisters, and the plastics materials of which the canisters are made—cross linked polyethylene is preferred—preclude permanent deformation and damage to the canisters during storage or upon impact with an unyielding body or surface.

14 Claims, 8 Drawing Figures

BUOYANCY SYSTEM FOR LARGE SCALE UNDERWATER RISERS

BACKGROUND OF THE INVENTION

This invention relates to improvements in large scale underwater risers, and particularly is such as to provide a buoyancy system for large scale underwater risers which may be effective in deep waters, e.g., ocean waters of a depth of 3,000 meters or more.

Deep underwater drilling has become a requirement in order to tap sources of hydrocarbons from sites well below 1,000 meters or more underwater. In such drilling, a long drilling riser conduit extends between the site at the ocean floor to the vessel or floating platform. Such riser normally comprises a string of units (known as joints), the individual units being connected by means of flanges with one another.

One of the problems engendered in deep sea drilling using riser conduits is the problem of locating and maintenance of the riser with respect to the platform or vessel, particularly where the surface vessel or platform may be subjected to considerable movement both horizontally and vertically due to current, wave and wind action. Such problems, of course, may subject the risers to excessive axial and buckling stresses.

Generally speaking, a principal requirement for stability of the riser—i.e., immunity to buckling or other stress failures, etc.,—is that the riser must be maintained effectively in tension over its entire length. More specifically, the effective tension in a riser must be considered to be the pipe wall tension diminished by the effects of pressure differential across the pipe wall, seawater pressure gradient, and so on.

Another problem which is encountered at sea, particularly in deep water conditions, is that occasionally the buoyancy of a riser system may be required to be adjusted, sometimes very rapidly.

Thus, while in the past the riser string has been kept under tension by such means as pulling on the upper end of the riser, either using counterweights or automatic tensioning equipment located on the vessel, the continuing search for hydrocarbons in deeper ocean environments has made these proposals, on their own, incapable of handling greater depths.

Of late, accordingly, it has been proposed to provide buoyancy devices for risers which would be capable of attaining the required buoyancy capabilities at greater depths, so as to properly maintain the risers. One such means has been the use of syntactic foam; and floatation air cans have also been proposed as buoyancy devices for deep sea risers.

A well known detriment of syntactic foam, however, is that it loses its buoyancy capacity due to absorption of water or compaction of the syntactic material, especially at increased depths. Thus, acceptance testing—i.e., testing prior to actual use—is normally a requirement for these foams, primarily to determine the buoyancy loss due to the ingress of water, so that allowances can be made for such losses. Further, any damage to the skin of such foams may materially accelerate the diminishing buoyancy capacity. Visual inspection does not normally enable a determination to be made as to the relative capacity of the foam, and it therefore may require a check of the air weight of the foam in order to determine its relative floatation or buoyancy capacity.

Moreover, while syntactic foam does provide passive buoyancy, such that its buoyancy level remains relatively constant if buoyancy losses are discounted, its ultimate depth capability is limited. Still further, in an emergency situation, (or indeed a planned dis-connect situation) where it is necessary to rapidly reduce buoyancy of a riser in order to maintain stability of such as a pendulating riser string, it is very expensive to provide means to dump the syntactic foam and especially when it is considered that it is probably or practically impossible to recover the syntactic foam once it has been dumped.

There have also been several floatation air can designs proposed to provide riser string buoyancy for deep sea drilling.

According to one prior art proposal, as disclosed in RHODES et al, U.S. Pat. No. 3,017,934 dated Jan. 23, 1962, a riser is buoyantly supported by a plurality of buoyancy chambers or cans, the chambers or cans being of progressively greater buoyancy per unit length in the direction along the longitudinal axis of the member with increasing water depth. In accordance with one embodiment disclosed by RHODES et al, buoyancy cans are provided which are directed with their open bottoms towards the ocean floor, which cans may be filled from a supply of gas leading to the bottom most can, nearest the ocean floor. A gas conduit allows the gas to flow from a full buoyancy can to the can immediately next above it until all the cans or pods are filled by the gas, which is usually compressed air. Of course, no gas is applied to the next can until the preceding one has been filled.

A more recent proposal is advanced in WATKINS U.S. Pat. No. 3,858,401, dated Jan. 7, 1975, and assigned to Regan Offshore International, Inc. According to WATKINS, floatation for underwater well risers is provided by a plurality of open bottom, buoyancy gas-receiving chambers, which are mounted about the riser conduit. A gas conduit is provided by WATKINS for the delivery of a gas, such as compressed air, to each of the chambers. Gas is admitted to each chamber through an associated valve for each chamber, each of the valves having a floating valve member. Gas supply to a chamber is discontinued when the valve member closes the valve orifice on replacement of the water in the chamber, i.e., when the floating valve member is no longer supported by water. Thus when upper chambers are filled by the gas, and on closing of the valve associated with each chamber, the gas can flow into the next chambers below, instead of gas leaking from the bottoms of the upper chambers.

The proposal by WATKINS suggests embracing the riser by concentrically disposed, open ended chambers. While this system maximizes use of the space for air buoyancy, the system produces a significant pressure differential between the gas—usually air—and the surrounding water which must be accounted for in the structural design of each of the chambers. Furthermore, it is common practice to stack the risers prior to use, such as on the deck of the transport vessel or floating platform. Since the chambers concentrically surround each riser section or unit, the walls of the chamber must, therefore, exhibit the required strength. Thus, the chambers tend to be very heavy, thereby offsetting a significant percentage of the buoyancy gained.

Also, in order to allow for handling and storage, as the containers are attached to each riser section during such handling and storage, the chambers of the WATKINS systems are designed to present a smooth circular outer surface concentric to the axis of a riser. Such a smooth hydrodynamic surface is not desireable due to an increase of drag forces imposed by sub-surface currents and in waves, and the riser may be subject to vortex shedding vibration. In addition, the WATKINS system has certain difficulties due to the possible flexing of the riser conduit within the relatively rigid air chamber or container which surrounds it.

It will, of course, be apparent that a multiplicity of valves and the attendant piping can lead to malfunctioning of at least some of the valves, thereby possibly reducing the efficiency of the system.

The WATKINS patent indicates that the system can be used in drilling operations at up to depths of 6,000 feet (1,829 meters) below the water surface.

SUMMARY OF THE INVENTION:

It is an object of the present invention to provide a buoyancy system for risers which is more reliable and effective than the prior art systems.

A further object of the present invention is to provide a buoyancy system which can be used with risers operating at greater depths below the surface than prior art devices have been capable of operating.

A still further object of the present invention is to provide a buoyancy system which effectively overcomes corrosion, thereby obviating corrosion protection measures normally taken in floatation air chambers.

Yet another object of the present invention is to provide a buoyancy system which is more economical than prior art systems.

It is also an object of the present invention to provide an improved lightweight buoyancy chamber that may be readily installed on and removed from a riser section.

Also, in accordance with this invention, an improved method for achieving buoyancy of large scale underwater risers is provided.

Still another object of this invention is to provide a buoyancy system which may have adjustable buoyancy provisions, as the system is assembled to the riser, and which has re-flood capability so as to cancel the system buoyancy in the event of an emergency situation occuring.

To accommodate the above objects, the present invention comprises a canister which has a floodable, hollow structure which a curved vertical rear wall having a contour approximating in curvature the outer diameter of the riser with which the canister is to be employed, and a curved vertical front wall extending arcuately substantially in parallel with the rear wall. Vertical side walls and top-forming and bottom-forming walls are provided. An internal conduit means provides air communication between superimposed canisters. An air inlet in the bottom wall comprises a tube which extends at least partially into the interior of the canister and which is connected to a source of compressed air supplied to the air inlet from below the canister. At least one water outlet is provided in the bottom of the canister, permitting displacement of the water from the interior thereof upon the injection of compressed air thereinto at a pressure sufficient enough to expel the water from the floodable hollow interior thereof. A port is provided in the conduit means, so that when the water level within the floodable hollow interior reaches the level of the port, air communication is provided through the conduit to the canister next above.

Apart from a number of specific features to be discussed in greater detail hereafter, it should be noted that the present invention comprises also the optional provision, for each canister or for specific canisters—usually at least one for each riser section—of a valve in the top portion of the canister and operable by valve opening means such that when the valve is open the interior of the canister has fluid communication to the sea water in which the canister is immersed so as to be re-floodable through the valve. Generally, such valves are operable together with other valves on other canisters, which may be on the same riser section or on other riser sections, so that mutually connected canisters to the same valve operating means are gang-connected so as to be re-floodable simultaneously.

BRIEF DESCRIPTION OF THE DRAWINGS:

The invention is further described with reference to the accompanying drawings, in which.

and

Figure 7:
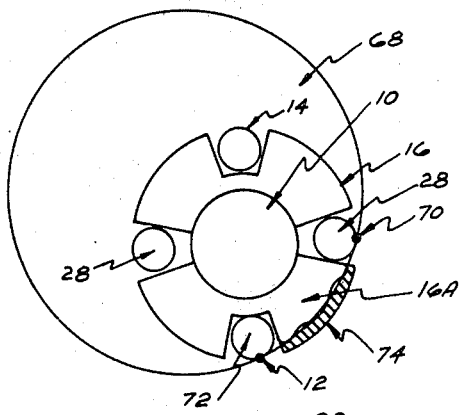
Figure 8:
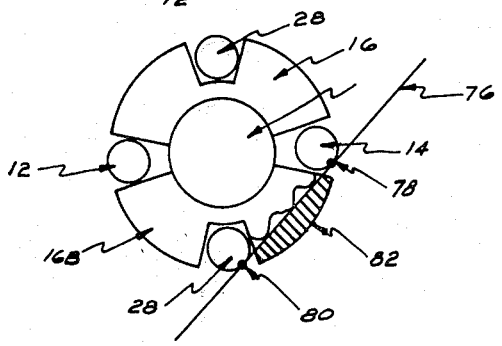

FIGS. 7 and 8 are simplified schematics showing two further interference/collision situations between a canister according to the present invention and an unyielding surface.

DESCRIPTION OF THE PREFERRED EMBODIMENTS

Figure 1:
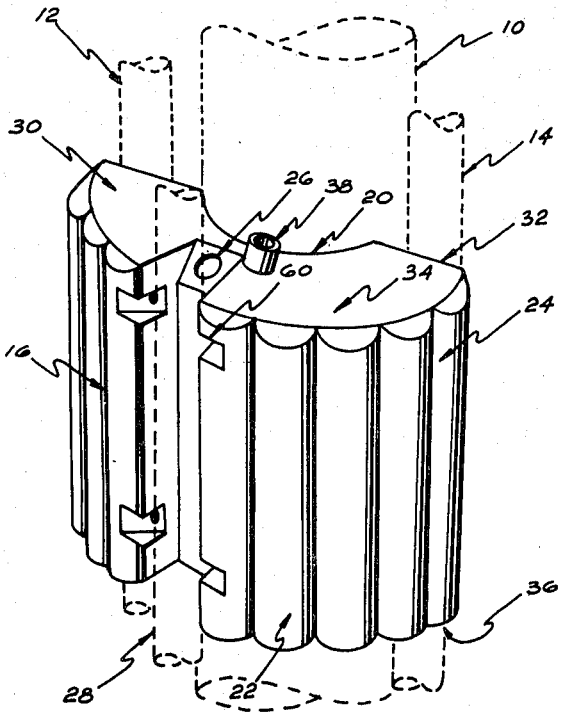
FIG. 1 is a perspective view showing a typical buoyancy canister in accordance with one embodiment of the present invention.

Referring first to FIG. 1, a riser 10 is shown in phantom outline, having choke and kill lines 12 and 14, to which a plurality of canisters 16 are assembled in the manner discussed hereafter. Generally, the riser is comprised of a plurality of sections, each of which is approximately 50 ft. long, joined by suitable flanges or the like, not shown, as is well known in the art.

The canister 16 is a substantially semi-circular segment, having a generally smooth inner curved vertical wall 20 and a curved outer wall 22. A plurality of ribs 24 may be formed in the outer wall 22, and a notch 26, in which a support tube 28 may be accommodated as discussed hereafter. The canister has vertical side walls 30 and 32, a top forming wall 34 and a bottom forming wall 36; so that the interior of the canister is hollow and as will be discussed in detail hereafter, is floodable. The shape of the cannister is such that it is designed to fit to a riser section at the rear wall 20; and as will be shown hereafter, the substantially semi-circular segment is such that it nearly surrounds one half of the riser section except for the choke and kill lines, and another similar canister placed on the opposite side of the riser provides nearly circumferential coverage of the riser section, at least between the choke and kill line on each side thereof.

Within each canister 16, at a skewed angle between the bottom 36 and top 34, there extends a conduit or cross tube 38, by which air communication from the interior of one canister 16 to the canister next above is accomplished. Generally, the cross tubes 38 are threadably fastened into their respective canisters, between a stub 40 in the bottom wall 36 of a respective canister, and a threaded stub 42 as at 43 in the top wall 34 of the same canister. As discussed hereafter, various cross tubes 38 can be installed in canisters so as to adjust the buoyancy rating of the canister, without the necessity of other major structural changes thereto.

Figure 2:
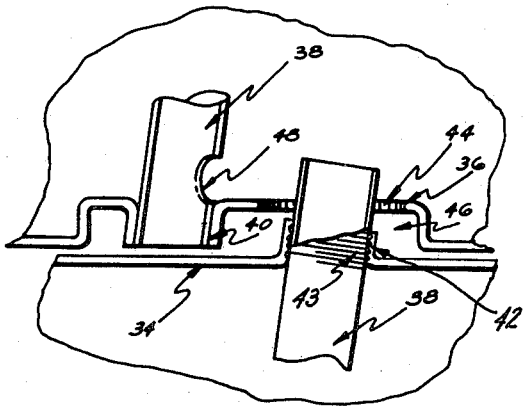
FIG. 2 is a cross-sectional view showing the interface between two canisters.
Figure 4:
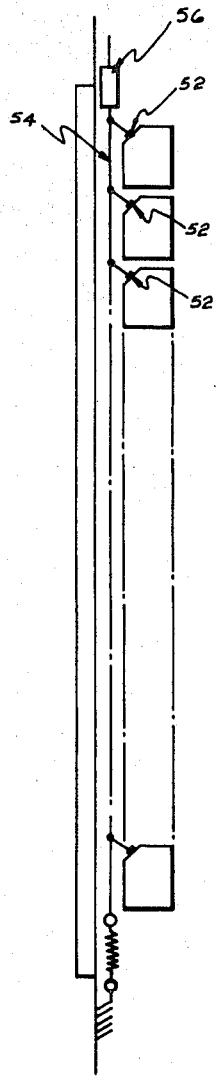
FIG. 4 is a schematic drawing showing the manner of operation of a preferred method of re-flooding.

In the usual embodiment, the cross tube 38 extends through the threaded stub 42 and through an opening 44—as seen in FIG. 2—into the interior of the next above canister. Further, the cross-section of the interfitting top and bottom wall portions 34 and 36 of superimposed canisters, as indicated in FIG. 2, includes the threaded boss or stub 42 which extends into a depression 46, for ease of assembly.

It should also be noted that the front and rear walls 22 and 20 of the canister are shown to be curved because of the relationship to the usual configuration of risers, but other configurations may also be designed. Further, as noted, the non-smooth front wall, which may have the ribs or vertical corrugations 24 formed therein, acts to preclude vortex shedding.

In general, the canisters 16 are rotationally moulded—or may be formed using other plastics moulding techniques—of a suitable mouldable plastic material. One such material which has been particularly chosen is available commercially from Phillips Petroleum, under the Trade Mark MARLEX CL100, which is a cross-linked polyethylene. That material has a specific gravity of approximately 0.97, so that it has substantially neutral buoyancy in water. Therefore, the air buoyancy obtained from the canister is not in any way offset by the weight of the canister itself, in water.

Each cross tube 38 has at least one port—usually just one—48 formed in it, near the bottom 36 of the canister. The position of the port above the bottom affects the buoyancy rating of the canister, which is particularly important for riser systems which are intended for operation at depth, as discussed hereafter.

The air charging operation of canisters according to the present invention is as follows:

Air is injected into the bottom of the lowest canister, by means of a suitable air supply 13 from a source of compressed air 15 at the surface. The air supply may be connected to a short stub which extends somewhat into the interior of the canister. In any event, the air is at a pressure which is sufficient to expel water from the canister, which water is expelled from openings in the bottom wall of the canister, such as through the opening 44 past the tube extension extending therethrough.

When the water level in the canister has reached a predetermined level which is determined by the position of the port 48 in the cross tube 38 above the bottom wall 36, air enters the cross tube and travels upwardly into the next above canister. (See FIG. 3.) The same sequence is repeated, working from the lowermost canister to the uppermost canister, until all of the canisters have had the water within the expelled to the level of the port 48 in their respective cross tube 38. Buoyancy is, of course, achieved by this process.

Figure 3:
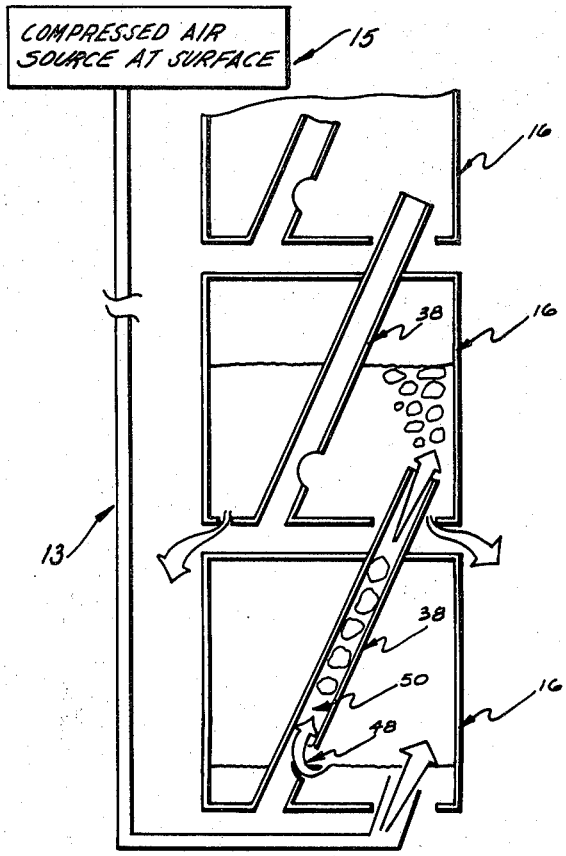
FIG. 3 is a diagrammatic representation of the air charging principle of canisters according to the present invention.

As air flows through the port 48, in the manner indicated by arrow 50 in FIG. 3, a slight resistance to air flow through the port occurs, resulting in a slight loss of air pressure. Since, in any canister, the air pressure within the canister equals the external water pressure at the same depth as the water level inside that canister, the difference in air pressure between two adjacent canisters is equivalent to the difference in the waterhead, approximately 1.5 psi or less, as compared with 22 psi on a conventional steel chamber of the sort referred to above with reference to the WATKINS patent. It can be seen that the pressure differential across the port and cross tube is, therefore, constant, irrespective of operating depth at which the canister is located below the water surface.

Obviously, as the air moves upward through the canisters, its volume increases as pressure reduces. It is therefore necessary to increase the area of the orifice or port 48 to accommodated the larger volume flow at a constant velocity. However, this can be very easily accomplished merely by providing that the ports within the cross tubes 38 are sufficiently large so as to allow a large volume of air flow rate at the available pressure differential. Thus, in a canister which is deep in the water, the water level will only be depressed sufficiently to partially uncover the port, and the orifice area through the port is automatically reduced so as to pass the actual air volume flow rate which exists at that particular ambient pressure. Further, if the air volume flow rate were to be increased slightly, there would be a slight increase in air pressure and the water level in the canister would lower slightly, causing an increase in the orifice area and thereby reducing the orifice restriction so at to reestablish air flow/flow rate/pressure equilibrium. It therefore follows that the ports 48 in each of the cross tubes 38 are such as to be self-compensating for operating depth. It should be noted, also, that as the canisters are not closely nested one to another, there is an essentially unrestricted flow path between them for water expelled from the canisters to flow away from the canisters.

Whether the canisters are filled at the time that they are deployed, or the entire riser is deployed and then the canisters are filled, is dependent upon operational conditions, requirement for achieving buoyancy within a short period of time, available compressor horse power input and pressure and flow output, etc.

Clearly, the buoyancy rating of a canister—either as to its position on a riser string or the amount of buoyancy required in a given situation—may be independent of the size of the canister if the cross tube 38 is replaced by another cross tube having the port 48 at a different level therein with respect to the bottom of the canister.

The necessity for re-flooding of canisters, so as to quickly reduce buoyancy, has been discussed above. Such necessity may, for example, occur where an instability in the riser string becomes apparent when the riser string begins to pendulate. In such instances, provision may be made by permitting one or more of the canisters on each riser section to be reflooded by water. So as to achieve such re-flooding as quickly as possible, a ball valve 52 may be provided on each canister to be flooded, and each of the ball valve 52 is attached to a trigger cable 54 which is operated by a pneumatic cylinder 56. Each of the valves is generally a ¼ turn ball valve, which when open merely exposes the interior of the canister to the seawater within which it is immersed. Upon operation of the pneumatic cylinder 56, upon command from the surface, all of the valves 52 which are connected to the respective control cable 54 are opened; and the re-flooding time for all of the canisters is only the time required to re-flood any one canister. All of the canisters on a riser section may be connected for re-flood operations, or only certain canisters, depending upon the circumstances and the foreseeable emergency situations where such re-flooding would be necessary.

Figure 5:
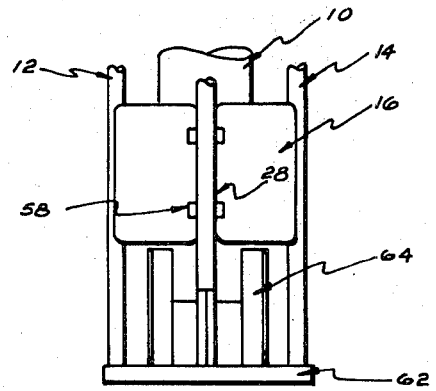
FIG. 5 is a simplified sketch showing a stowage configuration of a riser-section assembly having canisters according to the present invention assembled thereto.

Referring now to FIG. 5, the assembly of a canister to a riser is noted. In this case, it is the bottom most canister for the particular riser section that is illustrated. As seen also from FIG. 1, the canister 16 extends about the periphery of the riser 10 between the choke and kill lines 12 and 14. Each canister 16 is bolted to a support tube 28, and is secured by brackets such as brackets 58 mounted indents 60. The support tubes 28 extend the full length of each riser section, between riser end flanges 62, and are secured thereto. Thus, each canister is mechanically independently mounted with respect to the riser section 10; and the canisters are spaced apart along the support tube 28 so as to permit independent expansion and contraction of each canister, with temperature, and so as to preclude critical interfaces between canisters. In this manner, buoyancy is transferred to the riser. Needless to say, sections of air line may be installed between the uppermost canister on one riser section and the lowermost canister on the next riser section, in line; and two such connections would be required for each riser section, one on each side.

The handling and stowage of risers on board the surface platforms or vessels may be difficult, and each riser section may be subjected to considerable abuse because of its size and weight. However, the canisters of the subject invention are assembled to the riser section, usually on land, so that the necessity for difficult assembly at sea is precluded. Moreover, in order for the canisters to withstand the abuse of handling and storage, they must be such as to resist the hazards of handling and environmental abuse. Accordingly, it will be seen that the support tubes which are diametrically opposed, and the choke and kill tubes which are diametrically opposed but at right angles to the support tubes, comprise a cage around the riser 10 and within which the canisters are substantially located. However, the outer surfaces of the canisters may extend beyond a direct line drawn between any two cage elements (support tubes 28 and choke and kill lines 12 or 14) so that rather than providing structure which resists or precludes collision and stowage loads, the material of the canisters is such as to yield under an impact or stowage load to the extent which is determined and limited by the cage structure within which the canisters are mounted. For purposes of stowage, where the riser sections are stowed horizontally, stowage ribs 64 are provided, which are bolted to the riser end flanges 62, so that when the riser sections are placed for stowage with the riser end flanges substantially in alignment within a tolerance determined by the length of the stowage ribs 64, a situation may develop as indicated in FIG. 6.

Figure 6:
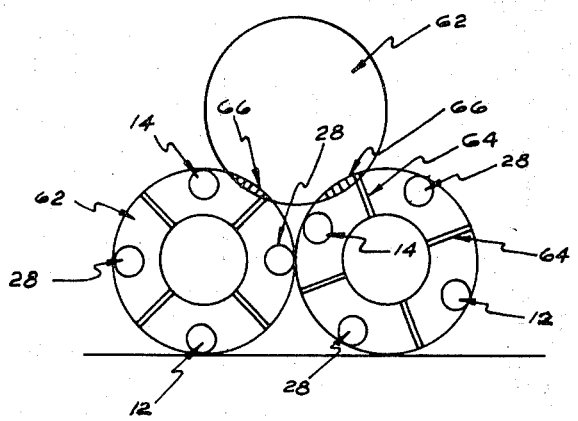
FIG. 6 is a simplified end view showing random stowage of three riser sections assembled according to this invention.

In FIG. 6, there are shown three risers having end flanges 62, and the usual support tubes and choke and kill lines. It will be seen that even in random stowage circumstances, the stowage ribs 64 together with the cage elements which are the support tubes or the choke and kill lines, preclude nesting and interference between the canisters except for very minor amounts as shown by shaded areas 66.

Even in handling, the canisters are yieldable to within limits determined by the geometry of the support cage, which in any event is acceptable within the yield limits of the material of which the canister have been formed. Thus, as shown in FIG. 7, a canister 16A is shown to have yielded in a circumstance where a riser is passing through a circular hole 68, to an extent determined by the point of contact 70 and 72, and as shown by the shaded area 74. Likewise, FIG. 8 shows the worst condition, where canister 16B is impacted upon a straight unyielding surface 76, to the extent that the canister has yielded to behind the contact point 78 and 80 to the extent shown by the shaded area 82. Especially when the preferred material, MARLEX CL100 cross-linked polyethylene is used, such yielding is acceptable, and when the impact force or pressure of the canister on the riser section has been relieved, the canister will regain its original configuration.

There follows a brief comparison of the air-weight advantages which are obtained, and the increased efficiency and cost effectiveness of the employment of canisters according to the present invention when compared with steel chambers or when compared with the air-weight of syntactic foam. TABLE 1, expressed in general terms and in terms of estimated weights per 50 ft. length, illustrates that considerably greater water depth limit is possible for any given vessel which may be restricted by its own stability limit.

TABLE 1

| | Foam or Steel Air Chamber | Canister |
|---|---|---|
| Riser weight per joint | 5T | 5T |
| Air weight of buoyancy system | 3.5T | 1T |
| Weight = riser + buoyancy | 8.5T | 6T |
| Vessel-stability limit for riser stowage | 1000T | 1000T |
| No. of riser joints with buoyancy system | 117 | 166 |
| Water depth limit | 5800 ft. | 8300 ft. |

Obviously, the lower structural modulus of the material of the canisters permits flexing of the canisters together with the riser, so that no stresses are caused either in the riser or the buoyancy system. Further, when cross-linked polyethylene is employed, such material is substantially impervious to leakage or corrosion, thereby assuring a maintenance or failure-free buoyancy system for large scale underwater risers.

In certain deep water drilling operations, the surface of the riser pipe may reach temperatures of 80° C. or 85° C. In such cases, it may be necessary to provide a water-duct space between the rear walls 20 of the canisters and the riser wall, so as to permit circulation of cooling water or even seawater therethrough.

The angle at which the cross tube extends within the canisters may be approximately 30° with respect to the vertical. The specific angle is not significant, and may be chosen so as to most easily effect assembly of canisters in a string, and insertion of various cross tubes into the canisters to change the buoyancy rating of any respective canister.

The corrugations on the outer surface of the canisters may be formed other than vertical—i.e., parallel to the axis of the riser—so that a helical strake may be effected by the ribs or corrugations formed in the outer surface of the buoyancy system when it is attached to a riser. In general, as noted, the non-smooth profile creates a three dimensional turbulence which is desirable and efficient in the elimination of vortex shedding vibration of the riser system.

Other changes, amendments and configurations to a buoyancy system and canisters therefor may be readily designed and made, without departing from the spirit and scope of the appended claims.

What I claim is:

1. A canister for use in association with a plurality of similar canisters, superimposed one on another, for providing buoyancy control of large scale underwater risers, comprising:

a floodable, hollow structure with a curved, vertical rear wall having a contour approximating in curvature the outer diameter of a riser section with which said canister is to be employed; a curved vertical front wall extending arcuately substantially in parallel with said rear wall; vertical side walls; and top-forming and bottom-forming walls;

internal conduit means for providing air communication between superimposed canisters;

an air inlet in the bottom wall comprising a tube extending partially into the interior of said canister and connected to a source of compressed air supplied thereto from below said canister;

a water outlet in said bottom wall permitting displacement of water from the interior of said canister upon the injection of compressed air at a pressure sufficient enough to expel water therefrom; and, a port in said conduit means to permit air communication to said conduit and thence through said conduit to the canister next above so as to supply compressed air to said air inlet in said next above canister, whereby said internal conduit comprises the source of compressed air for said next above canister.

2. A canister in accordance with claim 1, wherein said curved vertical front wall has a non-smooth profile.

3. A canister in accordance with claim 1, wherein said bottom and top walls include depressions and boss formations, respectively, for locating one canister with its bottom wall on the top of another canister.

4. A canister in accordance with claim 1, wherein said internal conduit means comprises a tubular duct extending within said canister from said bottom wall to said top wall at an angle with respect to the vertical, and extending past said top wall so as to form the air inlet in a further canister placed above said canister, and where said tubular duct extends past said bottom wall, and said port is formed in said tubular duct at a point above said bottom wall.

5. A canister in accordance with claim 4, wherein said conduit means is threadably engaged in a stub located in said top wall and extends into a conduit stub located in said bottom wall.

6. A canister in accordance with claim 1, 2 or 3, further including a groove in said front wall extending substantially vertically and having a depth sufficient to receive therein a support tube for mechanically mounting a plurality of canisters with said riser section, and thereby to transfer buoyancy to said riser.

7. A canister in accordance with claim 1, where the material of which the canister is formed is a plastics material having a specific gravity approximately equal to that of seawater.

8. A buoyancy system for large scale underwater risers, comprising a plurality of canisters in accordance with claim 1; and wherein:

at least one canister for each riser section includes valve means situated in the top portion thereof, and operable by valve opening means such that, when said valve is open the interior of said canister has fluid communication to the ambient and is re-floodable through said valve when said canister is immersed in water.

9. A buoyancy system according to claim 8, wherein said at least one canister per riser section is connected to a valve operating means which is also connected to at least another canister on the same riser section, so that said mutually connected canisters to said valve operating means are gang-connected so as to be re-floodable simultaneously.

10. A buoyancy system for large scale underwater risers having choke and kill lines, comprising a plurality of canisters in accordance with claim 1; and wherein:

said canisters on each side of a riser section are secured to a respective support tube on either side thereof and sit between the choke and kill lines of the riser section, so that said canisters transfer buoyancy to said riser section through said support tubes; and said support tubes and said choke and kill lines provide a mechanical frame spaced from said riser section and within which said canisters are located.

11. A buoyancy system for large scale underwater risers, comprising a plurality of canisters in accordance with claim 1; and wherein:

the material of which each of said canisters is formed of a plastics material having a specific gravity approximately equal to that of seawater;

and the pressure differential across the wall of each canister between the compressed air within and the ambient seawater is at a gauge pressure lower than the bursting pressure which the material of said canister will withstand.

12. The buoyancy system of claim 11, wherein the height from bottom wall to top wall of each of said canisters is not greater than two meters; and the gauge pressure differential of the compressed air within each said canister and the ambient seawater is, therefore, a waterhead of seawater equivalent to the height of compressed air column within each said canister, and not greater than two meters of seawater.

13. The buoyancy system of claim 12, wherein a plurality of canisters is provided in vertically disposed relationship parallel to the axis of any one riser section.

14. The buoyancy system of claim 13, wherein the combined volumes of said plurality of canisters associated with any one riser section is such that buoyancy is provided to the riser section approximately equal to its weights in water.

* * * * *